US009316970B2

(12) United States Patent
Kinoshita

(10) Patent No.: US 9,316,970 B2
(45) Date of Patent: Apr. 19, 2016

(54) IMAGE FORMING APPARATUS AND METHOD FOR CONTROLLING POWER SUPPLY TO HEATER OF FIXING UNIT BASED ON RESISTANCE VALUE OF HEATER

(71) Applicant: CANON KABUSHIKI KAISHA, Tokyo (JP)

(72) Inventor: Takeshi Kinoshita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/600,375

(22) Filed: Jan. 20, 2015

(65) Prior Publication Data

US 2015/0220043 A1 Aug. 6, 2015

(30) Foreign Application Priority Data

Feb. 4, 2014 (JP) ..... 2014-019245

(51) Int. Cl.
*G03G 15/20* (2006.01)

(52) U.S. Cl.
CPC ..... *G03G 15/2042* (2013.01)

(58) Field of Classification Search
CPC ..... G03G 15/2078; G03G 15/2082; G03G 15/5029; G03G 15/80; G03G 15/2039; G03G 15/2042
USPC ..... 399/45, 69, 70, 334
See application file for complete search history.

(56) References Cited

U.S. PATENT DOCUMENTS

2012/0321334 A1* 12/2012 Asano ..... 399/69

FOREIGN PATENT DOCUMENTS

JP 2006343690 A 12/2006

* cited by examiner

*Primary Examiner* — Hoang Ngo
(74) *Attorney, Agent, or Firm* — Fitzpatrick, Cella, Harper & Scinto

(57) ABSTRACT

An image forming apparatus for heating and fixing a toner image formed on a recording medium, includes: a feeding unit configured to respectively set recording media of different sizes; a plurality of heating units with heat generation parts, which generate heat by receiving a supply of power, each heat generation part being at a different position on the respective heating unit; a control unit configured to individually control the supply of power or a power interruption to the plurality of heating units in accordance with the size of the recording medium set in the feeding unit; and a detection unit configured to detect the current value of the heating unit to which power is supplied.

4 Claims, 10 Drawing Sheets

IMAGE FORMING APPARATUS AND METHOD FOR CONTROLLING POWER SUPPLY TO HEATER OF FIXING UNIT BASED ON RESISTANCE VALUE OF HEATER

BACKGROUND OF THE INVENTION

1. Field of the Invention

The present invention relates to an image forming apparatus such as copier, printer and the like using an electrophotographic system.

2. Description of the Related Art

Conventionally, in a generally available image forming apparatus, it is desired to start printing immediately after the image forming apparatus is powered on or is recovered from a sleep mode. To that end, the temperature of a fixing device needs to rapidly be raised to a predetermined temperature or more, which necessitates increasing the amount of power supplied to the fixing device. On the other hand, the current rating of a receptacle of a commercial AC power source is regulated. Due to this, only a current less than a rated current is allowed to be supplied, which is a problem.

For such problem, there is an image forming apparatus as disclosed in Japanese Patent Application Laid-Open No. 2006-343690. In the image forming apparatus, means to detect current flowing into a fixing device is provided and control is performed to supply more current to the fixing device with less than a rated current.

Also, FIG. 10 illustrates an example of a fixing controller for controlling current flowing into the fixing device of the image forming apparatus. The fixing controller as illustrated in FIG. 10 comprises a main heater 501*a*, a sub heater 501*b*, an AC power source 502, a current detection circuit 503, a central processing unit (CPU) 504, a relay 505, a first triac 507, a second triac 506, and a safety circuit 508.

The main heater 501*a* and the first triac 507 are connected in series. Likewise, the sub heater 501*b* and the second triac 506 are connected in series. Also, the main heater 501*a* and the first triac 507 are connected in parallel with the AC power source 502. Likewise, the sub heater 501*b* and the second triac 506 are connected in parallel with the AC power source 502. The first triac 507 and the second triac 506 are ON/OFF controlled by a heater signal from the CPU 504. The relay 505 is disposed between each heater and the AC power source 502. The relay 505 interrupts power supply to each heater according to a detection result of the safety circuit 508. Each triac is turned ON according to the heater signal from the CPU 504 and power is supplied to each heater by phase control. In this state, the current detection circuit 503 detects the total current flowing into the main heater 501*a* and the sub heater 502*b*. As mentioned, the detected current is the total current flowing into the fixing device in a state where the two heaters are simultaneously turned ON.

In a method for detecting the current value as mentioned above, when each triac of two heaters is simultaneously turned on, the current value is detected. Therefore, the detected current value represents the total current value flowing into the two heaters, which prevents accurate detection of the current value for each heater. This arrangement, therefore, leaves a problem that accuracy of phase control performed for every heater cannot be improved. Also, it is desired to individually detect the heater resistance value of each heater. On the other hand, as the number of heaters provided with the fixing device increases, the time required to detect the resistance value also increases. This arrangement, therefore, leaves a problem that the start of printing is delayed.

SUMMARY OF THE INVENTION

According to the present disclosure, an image forming apparatus for heating and fixing a toner image formed on a recording medium comprises: a feeding unit configured to respectively set a recording medium of different sizes; a plurality of heating units with heat generation parts, which generates heat by receiving power supply, each of the heat generation part being provided at different positions on the respective heating unit; a control unit configured to individually control power supply or power interruption to the plurality of heating units in accordance with the size of the recording medium set in the feeding unit; and a detection unit configured to detect the current value of the heating unit to which power is supplied.

Further features of the present invention will become apparent from the following description of exemplary embodiments (with reference to the attached drawings).

DESCRIPTION OF THE EMBODIMENTS

A description is provided below with regard to an embodiment in a case where the present invention is applied to an image forming apparatus such as copier, printer and the like which transfers toner images formed on an image carrier onto a recording medium using an electrophotography process technology to heat and fix the toner images transferred onto the recording medium.

First Embodiment

Figure 1:
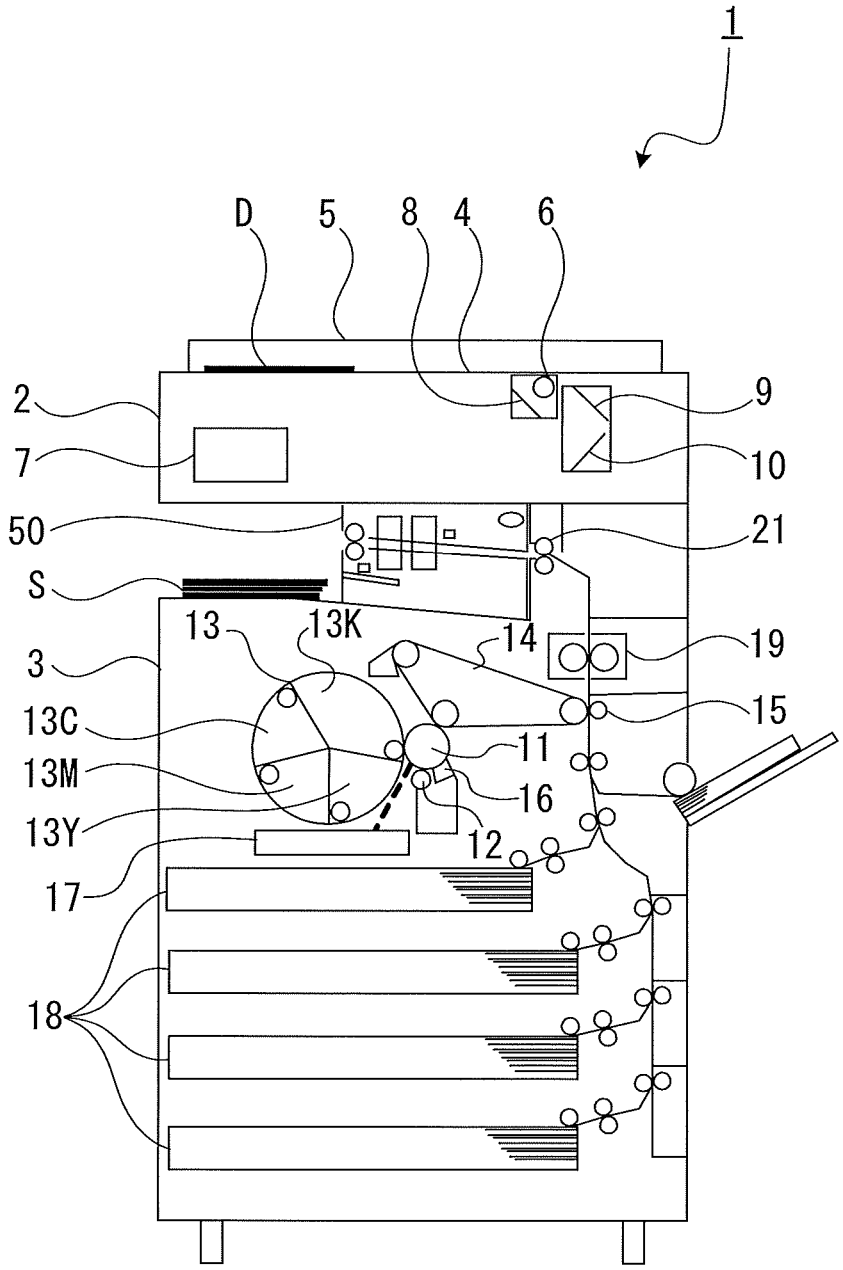
FIG. 1 is a schematic longitudinal view of an image forming apparatus according to a first embodiment.

FIG. 1 is a schematic longitudinal view illustrating an example of an image forming apparatus according to the present embodiment. The image forming apparatus 1 illustrated in FIG. 1 comprises an image reading unit 2 and an image forming unit 3.

The image reading unit 2 illustrated in FIG. 1 includes a document table 4 formed of a transparent glass plate fixed and provided at an upper portion of the image reading unit 2, an original document pressing plate 5, a lamp 6, an image processing unit 7, and reflection mirrors 8, 9, and 10. An original document D is placed at a predetermined position on the document table 4 with its image surface oriented downward. Then, the original document D is fixed and pressed by the original document pressing plate 5. The lamp 6 is provided on a lower side of the document table 4 and illuminates the image surface of the original document D placed at the document table 4 with light. The image processing unit 7 performs image processing of an optical image of the original document D guided by the reflection mirrors 8, 9, and 10. Note that the lamp 6 and the reflection mirrors 8, 9, and 10 move at a predetermined speed to scan the original document D.

The image forming unit 3 illustrated in FIG. 1 comprises a photosensitive drum 11, a primary charging roller 12, a rotary developing unit 13, an intermediate transfer belt 14, a transfer roller 15, a cleaner 16, a laser unit 17, sheet cassettes 18, a fixing device 19, and a delivery roller pair 21. The photosensitive drum 11 works as an image carrier in an image forming process. Based on image data read by the image reading unit 2, the laser unit 17 irradiates the photosensitive drum 11 with the optical image. Through the irradiation of the optical image, electrical latent images are formed on the surface of the photosensitive drum 11. The primary charging roller 12 uniformly charges a surface of the photosensitive drum 11 before laser light irradiation. The rotary developing unit 13 adheres magenta (M), cyan (C), yellow (Y), and black (K) toners to the electrostatic latent images formed on the surface of the photosensitive drum 11 to form toner images. The toner images developed on the surface of the photosensitive drum 11 are transferred onto the intermediate transfer belt 14. The toner images transferred onto the intermediate transfer belt 14 are transferred onto the recording medium of sheet S by the transfer roller 15. Note that the sheet S is fed from a feeding unit of the sheet cassettes 18, configured to respectively set sheets of different sizes, and conveyed along with a conveyance path of the sheet formed in the image forming apparatus 1. As mentioned, the sheet cassettes 18 are configured to respectively set sheets of different sizes and work as a feeding unit for feeding the sheet S. The cleaner 16 removes the toners remaining on the photosensitive drum 11 after the toner images are transferred.

Here, a description is given in detail with regard to the rotary developing unit 13. The rotary developing unit 13 is a developing unit using a rotary developing system. The rotary developing unit 13 comprises a developing devices 13K, 13Y, 13M and 13C. The rotary developing unit 13 is configured to be rotatable by a motor (not shown). For example, when forming a monochrome toner image on the surface of the photosensitive drum 11, the developing device 13K is moved through rotation to a developing position that is proximate to the photosensitive drum 11, to thereby develop the toner image. Similarly, when forming a full-color toner image, each of the developing devices is arranged at the developing position through the rotation of the rotary developing unit 13, to thereby develop the toner image of the corresponding color. The toner images developed on the surface of the photosensitive drum 11 by the rotary developing unit 13 are transferred onto the intermediate transfer belt 14. Thereafter, the toner images on the intermediate transfer belt 14 are transferred onto the sheet S by the transfer roller 15. The fixing device 19, arranged on the downstream side conveyance path of the image forming apparatus 3, fixes the toner images transferred onto the sheet S to the sheet. The sheet S onto which the toner image has been fixed by the fixing device 19 is discharged from the image forming apparatus 1 through the delivery roller pair 21. A post-processing is performed for the sheet S delivered from the image forming apparatus 1. The post-processing includes stapling the sheet S for every predetermined number of sheets by a post-processing apparatus 50.

Figure 2:
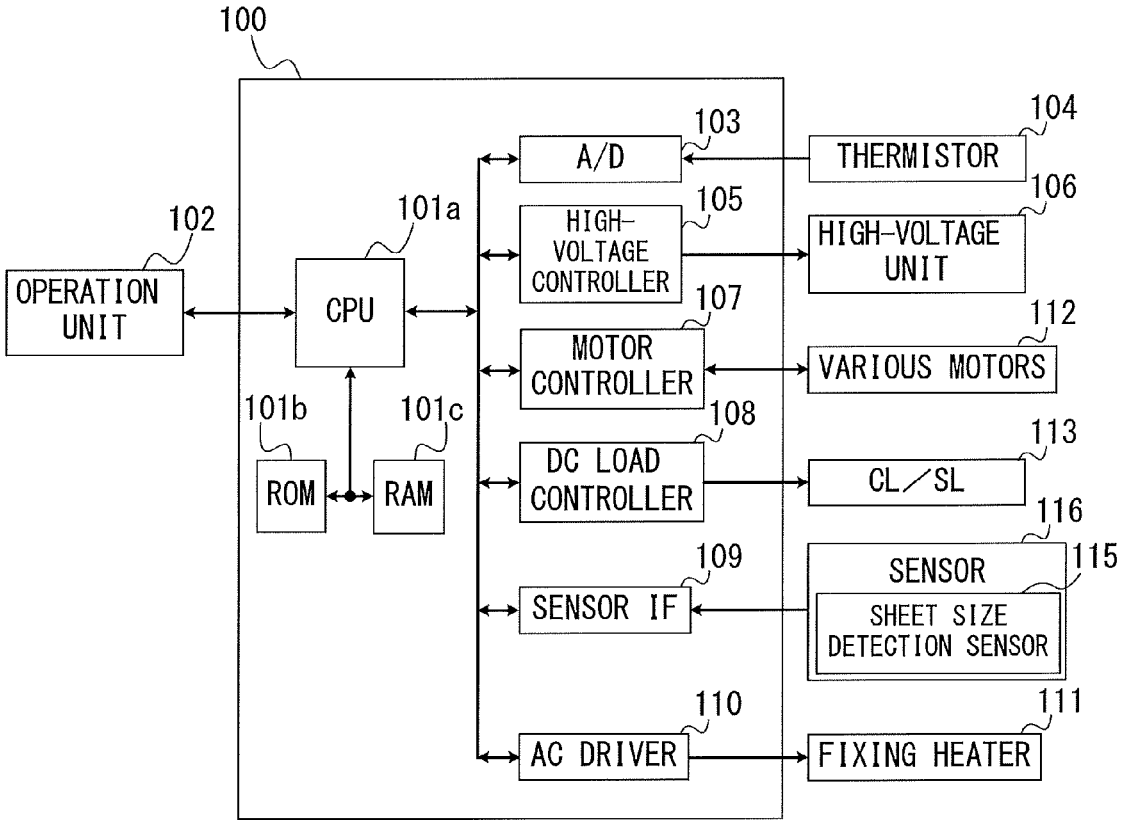
FIG. 2 is a block diagram illustrating an example of a control unit of the image forming apparatus.

FIG. 2 is a block diagram illustrating an example of a control unit of the image forming apparatus 1. The image forming apparatus 1 is totally controlled by a control unit 100 illustrated in FIG. 2. The control unit 100 comprises a central processing unit (CPU) 101*a*, a read only memory (ROM) 101*b*, and a random access memory (RAM) 101*c*. The control unit 100 also comprises an A/D (analog/digital converter) 103, a high-voltage controller 105, a motor controller 107, a DC load controller 108, a sensor IF (interface) 109, and an AC driver 110. Also, the control unit 100 is connected to an operation unit 102, a thermistor 104, a high voltage unit 106, a fixing heater 111, various motors 112, a clutch/solenoid (CL/SL) 113, and sensors 116.

The CPU 101*a* controls driving of each load disposed on the image forming apparatus 1. Also, the CPU 101*a* controls the apparatus to collect and analyze information on the sensors and controls the apparatus to receive operation input from a user interface of the operation unit 102. The ROM 101*b* stores programs for executing, by the CPU 101*a*, various sequences related to a predetermined image forming sequence. The RAM 101*c* temporarily or permanently stores various data when the various sequences are executed by the CPU 101*a*. The RAM 101*c* stores information on a high voltage setting value for the high-voltage controller 105, information on various data as will be described later, and information on an image forming instruction received by the operation unit 102. As mentioned, the RAM 101*c* functions as a storage means to store (memorize) various data. Note that the operation unit 102 receives various setting information, such as copy magnification, density setting values, and the like set by a user. In addition, the operation unit 102 shows a state of the image forming apparatus 1 to the user. For example, the operation unit 102 shows the number of sheets on which images have currently been formed, shows information indicating whether or not the image forming apparatus 1 is in the middle of the image formation operation, shows occurrence of jam and the position thereof, and the like.

A motor, a DC load of a clutch/solenoid and the like, and sensors such as a photo interrupter and a micro switch are disposed on each part in the image forming apparatus 1. It means that through an appropriate driving of the disposed motor, each DC load and the like, transfer material such as the sheet S is conveyed and each unit is driven. Further, the operation is monitored by the sensors. In particular, the CPU 101*a* receives a detection signal detected by the sensors 116 disposed on the image forming apparatus 1 via the sensor IF 109. Based on the detection result, the CPU 101*a* controls the apparatus such that the motor controller 107, the DC load controller 108, and the like output a predetermined control signal to each load. Note that a sheet size detection sensor 115 detects the size of the sheet set in the sheet cassettes 18. The high-voltage controller 105 outputs various high voltage control signals to the high voltage unit 106. Then, the high voltage unit 106 applies an appropriate high voltage to a primary charger and the like. The motor controller 107 outputs an operation control signal to the various motors 112. Further, the DC load controller 108 outputs an operation control signal to the clutch/solenoid 113. As a result, the operation in connection with the image formation by the image forming apparatus 1 is controlled. The AC driver 110 controls the turning ON/OFF of a power supply supplying power to the fixing heater 111, the fixing heater 111 being provided inside the fixing roller of the fixing device 19 to heat the fixing roller.

The A/D 103 converts a resistance value change of the thermistor 104, the resistance value of which changes in accordance with a temperature change of the fixing roller, to a voltage value. Then, the A/D converter inputs the voltage value to the CPU 101*a* as a digital value. The CPU 101*a* controls the AC driver 11 based on the temperature data.

Figure 3:
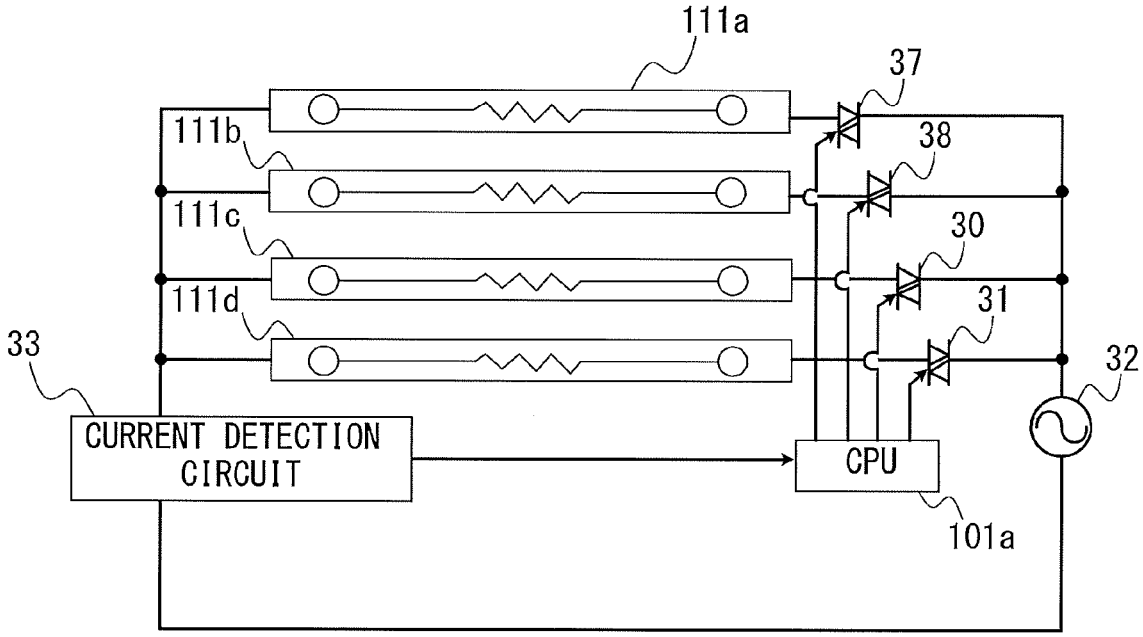
FIG. 3 is a diagram illustrating an example of a power supply control circuit for controlling power supply to a fixing heater.

FIG. 3 is a diagram illustrating an example of a power supply control circuit for controlling the power supply to the fixing heater 111. The fixing heaters 111*a*, 111*b*, 111*c*, and 111*d* illustrated in FIG. 3 are the heaters with different resistance values. The respective fixing heaters are formed, for example, into rectangles illustrated in FIG. 3. The width of each fixing heater is formed, for example, in accordance with the maximum sheet width that the image forming apparatus 1 is capable of handling. The fixing heater 111*a*, capable of printing, is fed over from an AC power source 32 via a triac 37. The fixing heater 111*b* is fed power from the AC power source 32 via a triac 38. The fixing heater 111*c* is fed power from the AC power source 32 via a triac 30. The fixing heater 111*d* is fed power from the AC power source 32 via a triac 31. Further, a current detection circuit 33 is connected between the AC power source 32 and each fixing heater. The detection result of the current value detected by the current detection circuit 33 is input to the CPU 101*a*. The CPU 101*a* controls the turning ON/OFF of each triac to respectively supply or interrupt the supply of power to each fixing heater. This enables the apparatus to control the temperature of each fixing heater. The detail of a configuration of each fixing heater will be described as below.

Figure 4:
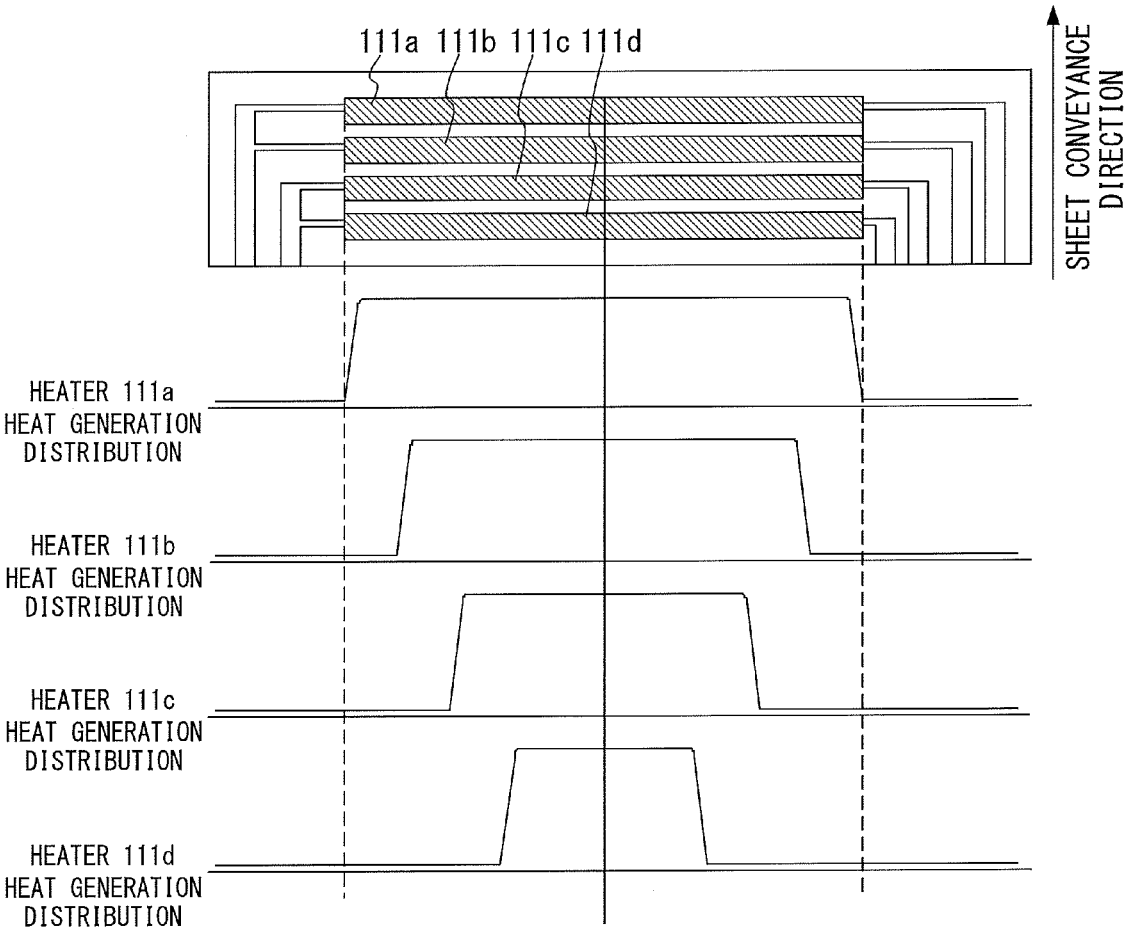
FIG. 4 is an explanatory diagram schematically illustrating configuration of the fixing heater.

FIG. 4 is an explanatory diagram schematically illustrating the configuration of the fixing heater. As shown in FIG. 4, the fixing heaters 111*a*, 111*b*, 111*c* and 111*d* in the fixing roller are arranged in a direction in which the longer side of each fixing heater is orthogonal to the conveyance direction of the sheet S. Further, the following relationship is established among the respective resistance values of each fixing heater. That is, resistance value of the fixing heater 111*a*<resistance value of the fixing heater 111*b*<resistance value of the fixing heater 111*c*<resistance value of the fixing heater 111*d*. The smaller the resistance value, the larger the calorific value becomes. In addition, as illustrated in FIG. 4, in the fixing heaters, the heat generation parts (heat generation distribution) are provided at different positions. In particular, as illustrated in a graph in FIG. 4, in the fixing heaters 111*a* and 111*b*, the heat generation parts are provided such that the entire surfaces thereof are uniformly heat-generated. Note that the width of the heat generation part of the fixing heater 111*b* is provided to be narrower than that of the fixing heater 111*a*. Also, in the fixing heaters 111*c* and 111*d*, the heat generation parts are provided such that parts near the central parts thereof are heated-generated. Note that the width of the heat generation part of the fixing heater 111*d* is provided to be narrower than that of the fixing heater 111*c* (that is, the fixing heater 111*d* is provided closer to the central part). As above, the fixing heaters 111*a*, 111*b*, 111*c* and 111*d* are provided to respectively have different heat generation patterns.

Figure 5:
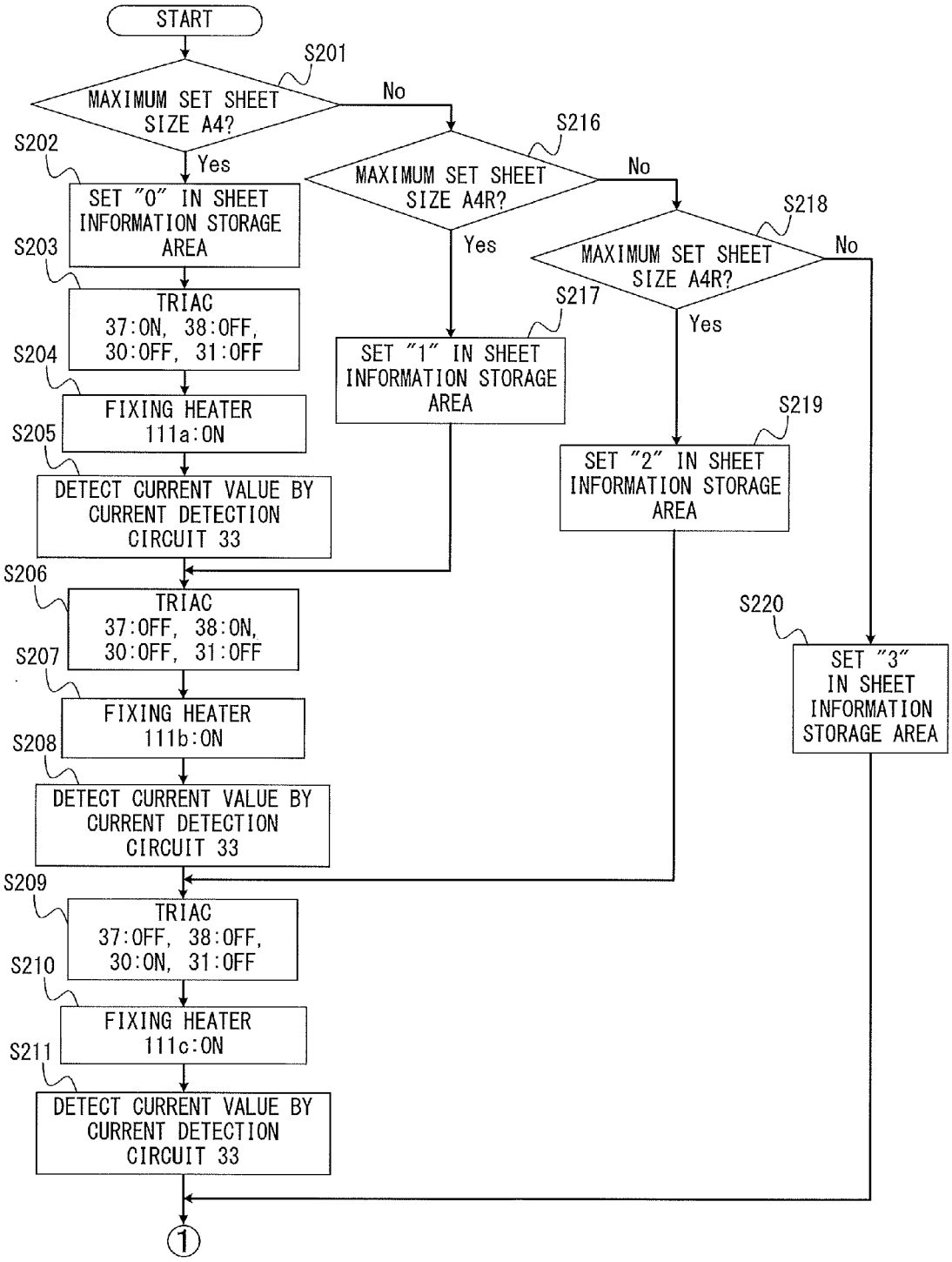
FIG. 5 is a flowchart illustrating an example of processing procedure of the image forming apparatus.
Figure 6:
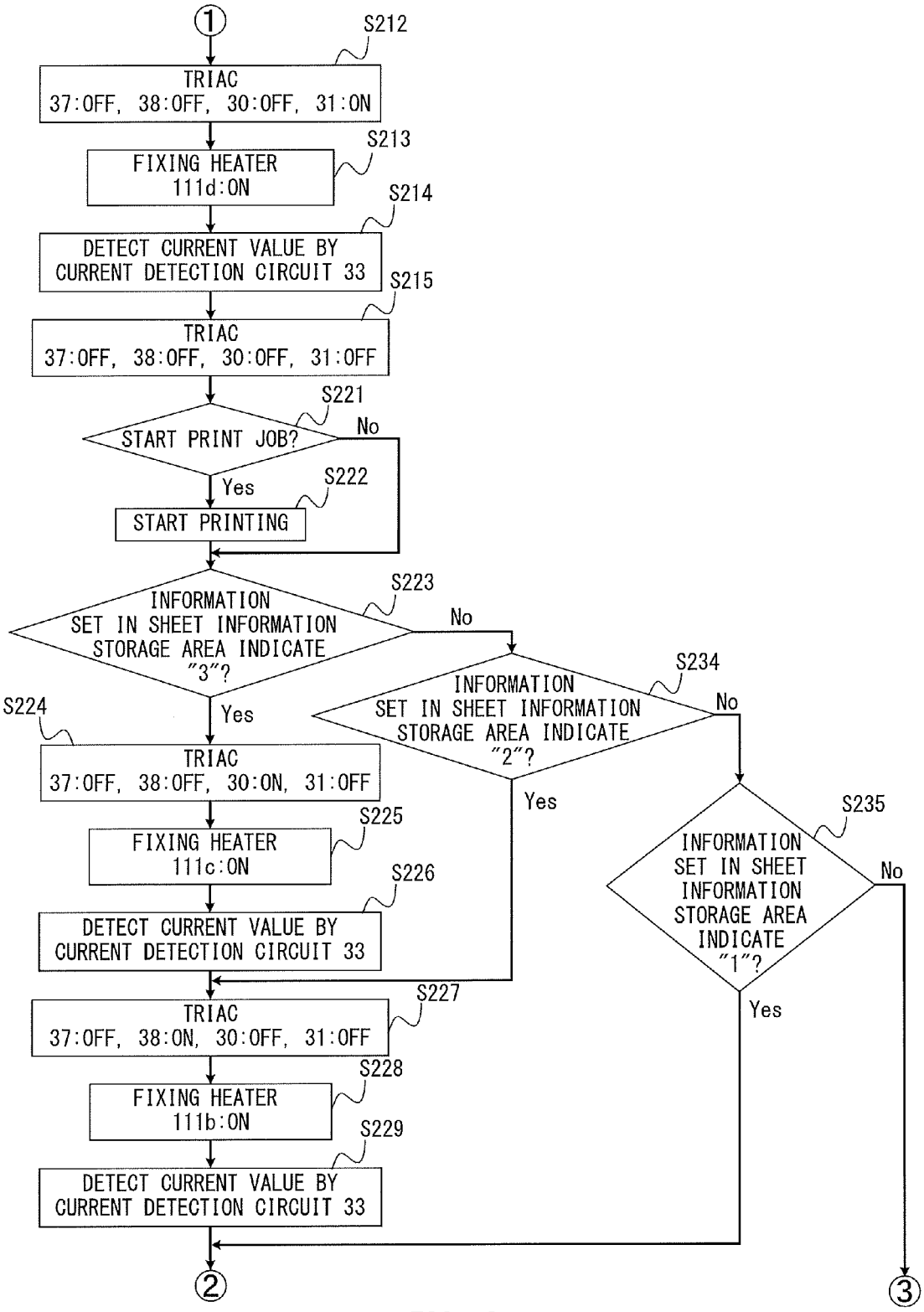
FIG. 6 is a flowchart illustrating an example of processing procedure of the image forming apparatus following FIG. 5.
Figure 7:
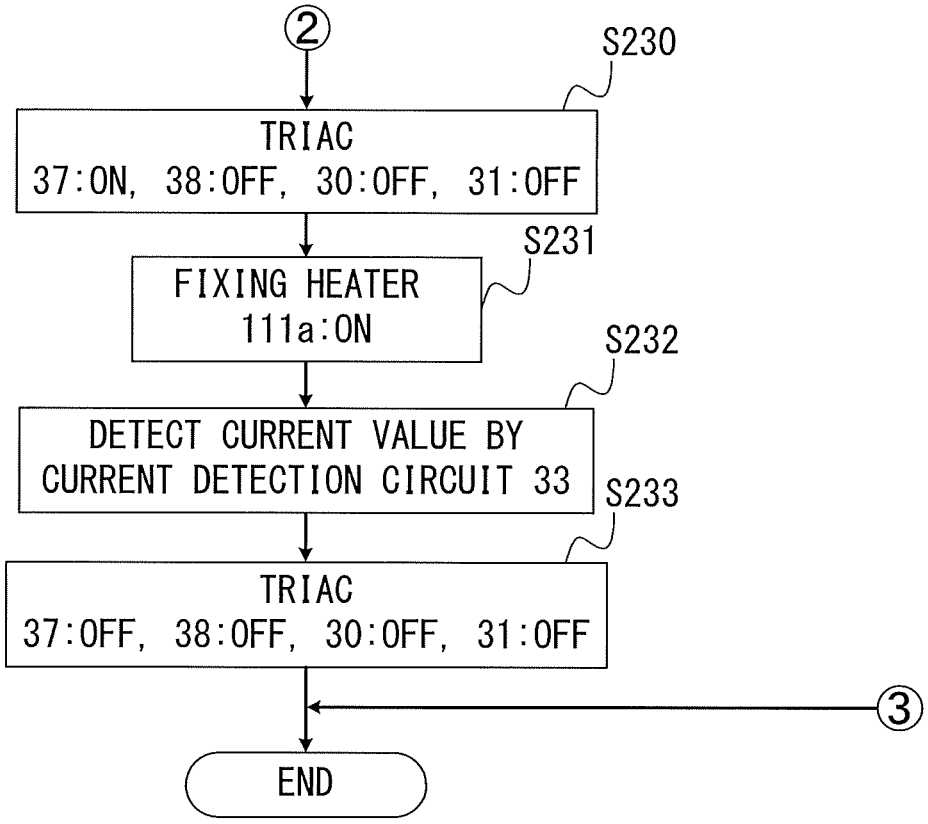
FIG. 7 is a flowchart illustrating an example of processing procedure of the image forming apparatus following FIG. 6.

FIGS. 5, 6 and 7 are flowcharts illustrating examples of a processing procedure of the image forming apparatus 1. Note that, in the description of the processing procedure of the image forming apparatus 1, the sheet cassettes 18 set sheets of four different sizes. Also, typical sheet sizes include A4 (297 [mm] in width direction), A4R (210 [mm] in width direction) and the like. A description is given here in the case where the size of the maximum sheet capable of being set in the sheet cassettes 18 is A4 size.

When the image forming apparatus 1 is started (powered on), the CPU 101*a* determines whether or not the size of the maximum sheet (maximum sheet size) set in the sheet cassettes 18 is A4 size based on the detection result of the sheet size detection sensor 115 (S201). If it is determined that the maximum sheet size is A4 size (S201: Yes), the CPU 101*a* sets "0" in a sheet information (recording medium information) storage area in the RAM 101*c* (S202). That is, the sheet information of "0" indicates that the maximum sheet size set in the sheet cassettes 18 is A4 size. When printing is performed under the above circumstance, all fixing heaters (111*a* to 111*d*) will be used by supplying power to (by electrifying) all fixing heaters. Therefore, the CPU 101*a* detects the resistance value of each heater in order before processing of Step S203 is started. As above, based on the maximum sheet size, the CPU 101*a* determines the fixing heater to which the power is to be supplied.

The CPU 101*a* controls the turning ON/OFF of each triac to electrify (turn ON) the fixing heater 111*a*. In particular, the triac 37 is turned ON and the triacs 38, 30 and 31 are turned OFF (S203) to electrify the fixing heater 111*a* (S204). Thereafter, the CPU 101*a* makes the current detection circuit 33 detect a current value of the fixing heater 111*a* (S205). Note that the CPU 101*a* makes the current detection circuit 33 detect a constant current. After the detection result from the current detection circuit 33 is stabilized, the CPU 101*a* controls the apparatus to perform current sampling. Further, the CPU 101*a* applies the current sampling method to the other fixing heaters to detect the current value.

When the detection of the current value of the fixing heater 111*a* is completed, the CPU 101*a* controls the turning ON/OFF of each triac to electrify the fixing heater 111*b*. In particular, the triac 38 is turned ON and the triacs 37, 30 and 31 are turned OFF (S206) to electrify the fixing heater 111*b* (S207). Thereafter, the CPU 111*a* makes the current detection circuit 33 detect the current value of the fixing heater 111*b* (S208).

When the detection of the current value of the fixing heater 111*b* is completed, the CPU 101*a* controls turning ON/OFF of each triac to electrify the fixing heater 111*c*. In particular, the triac 30 is turned ON and the triacs 37, 38 and 31 are turned OFF (S209) to electrify the fixing heater 111*c* (S210). Thereafter, the CPU 101*a* makes the current detection circuit 33 detect the current value of the fixing heater 111*c* (S211).

When the detection of the current value of the fixing heater 111*c* is completed, the CPU 101*a* controls turning ON/OFF of each triac to electrify the fixing heater 111*d*. In particular, the triac 31 is turned ON and the triacs 37, 38 and 30 are turned OFF (S212) to electrify the fixing heater 111*d* (S213). Thereafter, the CPU 101*a* makes the current detection circuit 33 detect the current value of the fixing heater 111*d* (S214). Then, the CPU 101*a* controls the apparatus to turn OFF all triacs 37, 38, 30 and 31 (S215). Then, the CPU 101*a* completes the apparatus to detect the current value of the fixing heaters immediately after the startup of the image forming apparatus 1.

Further, if it is determined that the maximum sheet size is smaller than A4 size (S201: No), the CPU 101*a* determines whether or not the maximum sheet size is A4R size (S216). If it is determined that the maximum sheet size is A4R size (larger than A4R size and smaller than A4 size) (S216: Yes), the CPU 101*a* sets "1" in the sheet information storage area in the RAM 101*c* (S217). That is, the sheet information of "1" indicates that the maximum sheet size set in the sheet cassettes 18 is A4R size. Then, based on the A4R size, the CPU 101*a* determines the fixing heater to which the power is to be supplied. Thereafter, the CPU 101*a* performs processing of Step S206. Note that, when printing is performed under this circumstance, the fixing heaters 111*b*, 111*c*, and 111*d* will be used. Therefore, the CPU 101*a* detects the resistance value of each fixing heater in order before processing of Step S206 is started. Also, the detection of the resistance value of the fixing heater 111*a*, which is not used when printing under this circumstance, is performed after the printing is completed. Details will be described later.

Also, if it is determined that the maximum sheet size is not A4R size (S216: No), the CPU 101*a* determines whether or not the maximum sheet size is B5R (S218). If it is determined that the maximum sheet size is B5R size (larger than B5R size and smaller than A4R size) (S218: Yes), the CPU 101*a* sets "2" in the sheet information storage area in the RAM 101*c* (S219). That is, the sheet information of "2" indicates that the maximum sheet size set in the sheet cassettes 18 is B5R size. Then, based on the B5R size, the CPU 101*a* determines the fixing heater(s) to which the power is to be supplied. Thereafter, the CPU 101*a* performs processing of Step S209. Note that, when printing is performed under this circumstance, the fixing heaters 111*b*, 111*c*, and 111*d* will be used. Therefore, the CPU 101*a* detects the resistance value of each heater in order before the processing of Step S209 is started. Also, the resistance value of the fixing heaters 111*a* and 111*b*, which are not used when printing under this circumstance, is detected after the printing is completed. Details will be described later.

Also, if it is determined that the maximum sheet size is not B5R size (S218: No), the CPU 101*a* sets "3" in the sheet information storage area in the RAM 101*c* (S220). That is, the sheet information of "3" indicates that the maximum sheet size set in the sheet cassettes 18 is smaller than B5R size. Thereafter, the CPU 101*a* performs processing of Step S212. Note that, when printing is performed under this circumstance, the fixing heater 111*d* will solely be used. Therefore, the CPU 101*a* detects the resistance value of the fixing heater 111*d* before the processing of Step S212 is started. Also, the resistance value of the fixing heaters 111*a*, 111*b*, and 111*c*, which are not used when printing under this circumstance, is detected after the printing is completed. Details will be described later.

Thereafter, the CPU 101*a* determines whether an instruction to start printing (start print job) is received via the operation unit 102 (S221) or not. If it is determined that the instruction to start printing is received (S221: Yes), the CPU 101*a* starts printing in accordance with the instruction (S222). After the printing is completed, or if it is determined that the instruction to start printing is not received (S221: No), the CPU 101*a* detects the resistance values of the fixing heaters which are not detected before the printing is started in accordance with the value stored in the sheet information storage area in the RAM 101*c*. Details of the processing will be described as below.

The CPU 101*a* determines whether the value stored in the sheet information storage area in the RAM 101*c* is "3" (S223) or not. If it is determined that the value is "3" (S223: Yes), the CPU 101*a* detects the resistance value of the fixing heaters 111*a*, 111*b*, and 111*c*, which are not detected before the printing is started. In particular, the CPU 101*a* controls turning ON/OFF of each triac to electrify the fixing heater 111*c*. Specifically, the triac 30 is turned ON and the triacs 37, 38, and 31 are turned OFF (S224) to electrify the fixing heater 111*c* (S225). Thereafter, the CPU 101*a* makes the current detection circuit 33 detect the current value of the fixing heater 111*c* (S226).

When the detection of the current value of the fixing heater 111*c* is completed, the CPU 101*a* controls turning ON/OFF of each triac to electrify the fixing heater 111*b*. In particular, the triac 38 is turned ON and the triacs 37, 30 and 31 are turned OFF (S227) to electrify the fixing heater 111*b* (S228). Thereafter, the CPU 101*a* makes the current detection circuit 33 detect the current value of the fixing heater 111*b* (S229).

When the detection of the current value of the fixing heater 111*b* is completed, the CPU 101*a* controls turning ON/OFF of each triac to electrify the fixing heater 111*a*. In particular, the triac 37 is turned ON and the triacs 38, 30 and 31 are turned OFF (S230) to electrify the fixing heater 111*a* (S231). Thereafter, the CPU 101*a* makes the current detection circuit 33 detect the current value of the fixing heater 111*a* (S232). Then, the CPU 101*a* controls the apparatus to turn OFF all triacs 37, 38, 30 and 31 (S233). As above, the image forming apparatus completes the detection of the current value of the fixing heater. Then, the image forming apparatus enters stand-by mode.

Further, if it is determined that the value stored in the sheet information storage area in the RAM 101*c* is not "3" (S223: No), the CPU 101*a* determines whether or not the value stored in the sheet information storage area in the RAM 101*c* is "2" (S234). If it is determined that the value is "2" (S234: Yes), the CPU 101*a* performs the processing of Step S227 to detect the resistance value of the fixing heaters 111*a* and 111*b*, which are not detected before the printing is started.

Further, if it is determined that the value stored in the sheet information storage area in the RAM 101*c* is not "2" (S234: No), the CPU 101*a* determines whether or not the value stored in the sheet information storage area in the RAM 101*c* is "1" (S235). If it is determined that the value is "1" (S235: Yes), the CPU 101*a* performs the processing of Step S230 to detect the resistance value of the fixing heater 111*a*, which is not detected before the printing is started.

Further, if it is determined that the value stored in the sheet information storage area in the RAM 101*c* is not "1" (S235: No), since the resistance value of all fixing heaters have already been detected, the CPU 101*a* completes the series of processing operations. Note that, in this embodiment, a description has been given with regard to the detection of the resistance value performed before the printing is started, in which current is detected in the order of the fixing heater whose resistance value is low. Not limited to the above, the order of detecting the resistance value performed before the start of the printing may optionally be set. Also, in this embodiment, a description has been given for a case where the order to detect the current of each fixing heater is determined based on the maximum sheet size stored in the sheet cassettes 18. Not limited to the above, the order to detect the current may be determined based on the sheet size of the sheet set in a particular sheet cassette.

As mentioned above, according to the image forming apparatus 1 of the present embodiment, the resistance value of the fixing heater corresponding to the maximum sheet size set in the sheet cassettes 18 (for example, A4 size) is first detected. Then, after the printing is completed, the resistance values of the rest of the fixing heaters are detected. This allows preventing any unnecessary delay of the print start time. In particular, any delay of print start timing after the startup of the image forming apparatus 1 can be prevented.

Second Embodiment

In this embodiment, a description will be given with regard to an example of processing procedure of the image forming apparatus in a case where a second sheet and subsequent sheets are printed successively or in a case where the image forming apparatus is recovering from a sleep mode. Note that the same reference symbols are used for the components same as those already described.

Figure 8:
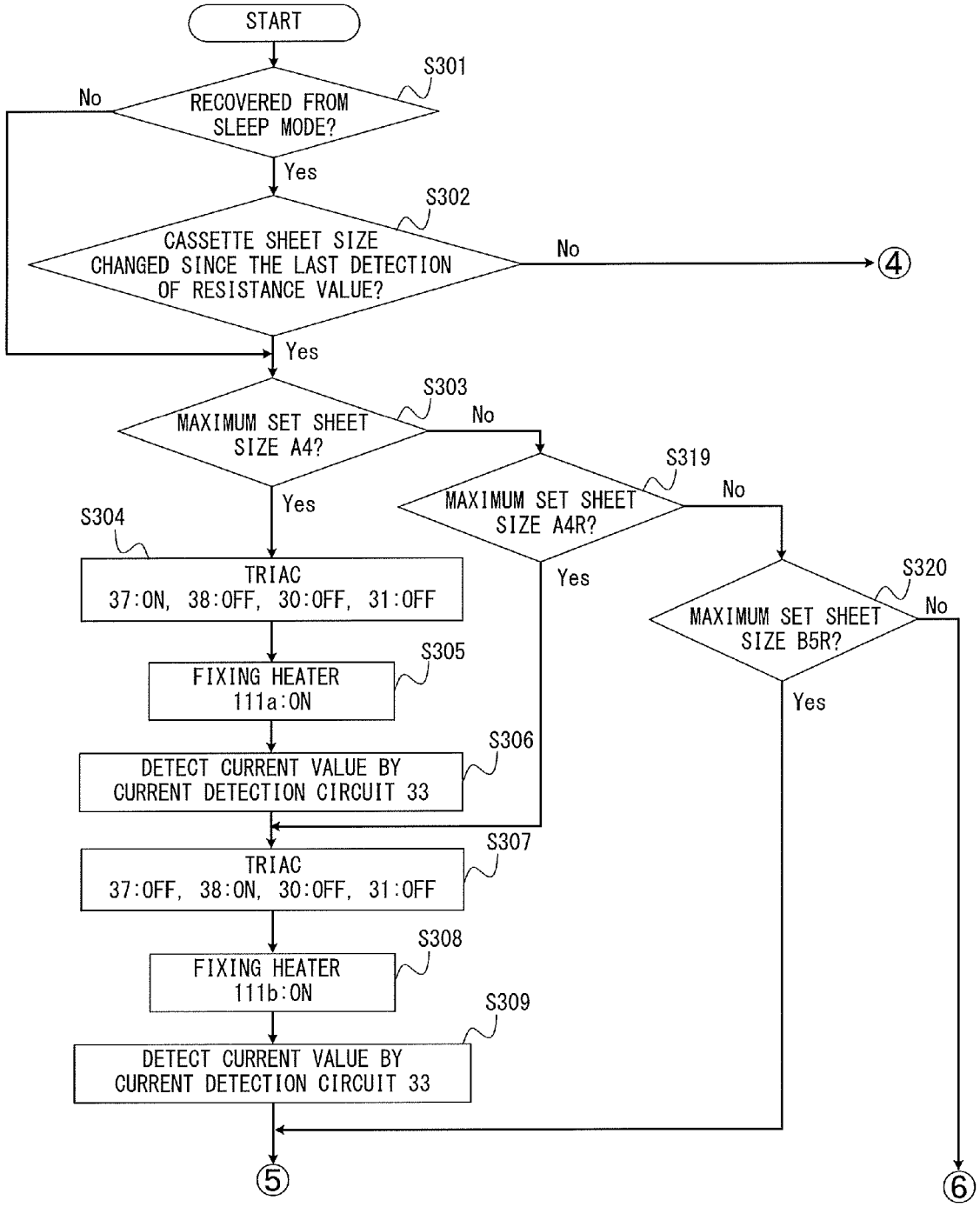
FIG. 8 is a flowchart illustrating an example of processing procedure of image forming apparatus according to a second embodiment.
Figure 9:
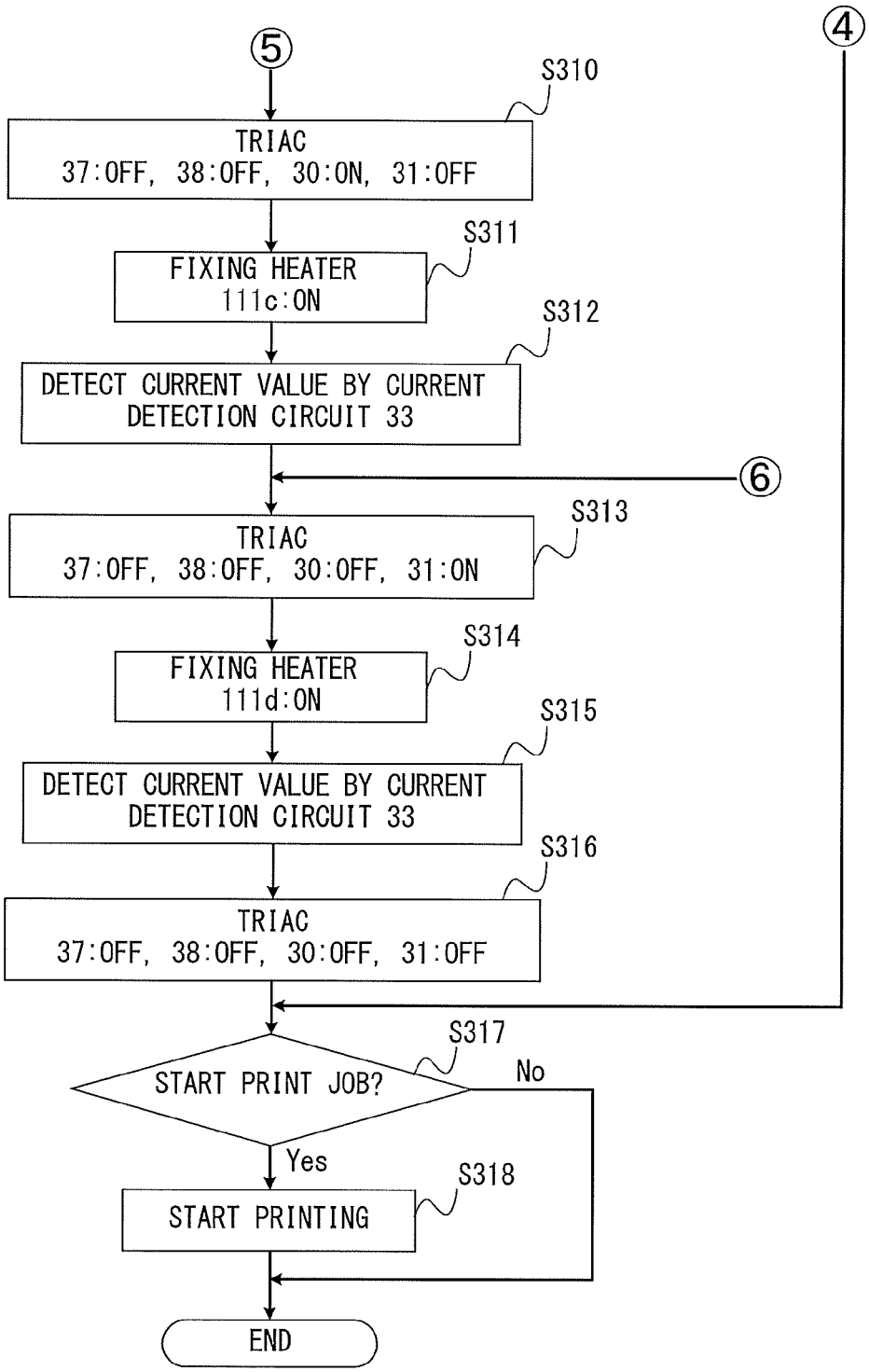
FIG. 9 is a flowchart illustrating an example of processing procedure of image forming apparatus following FIG. 8.
Figure 10:
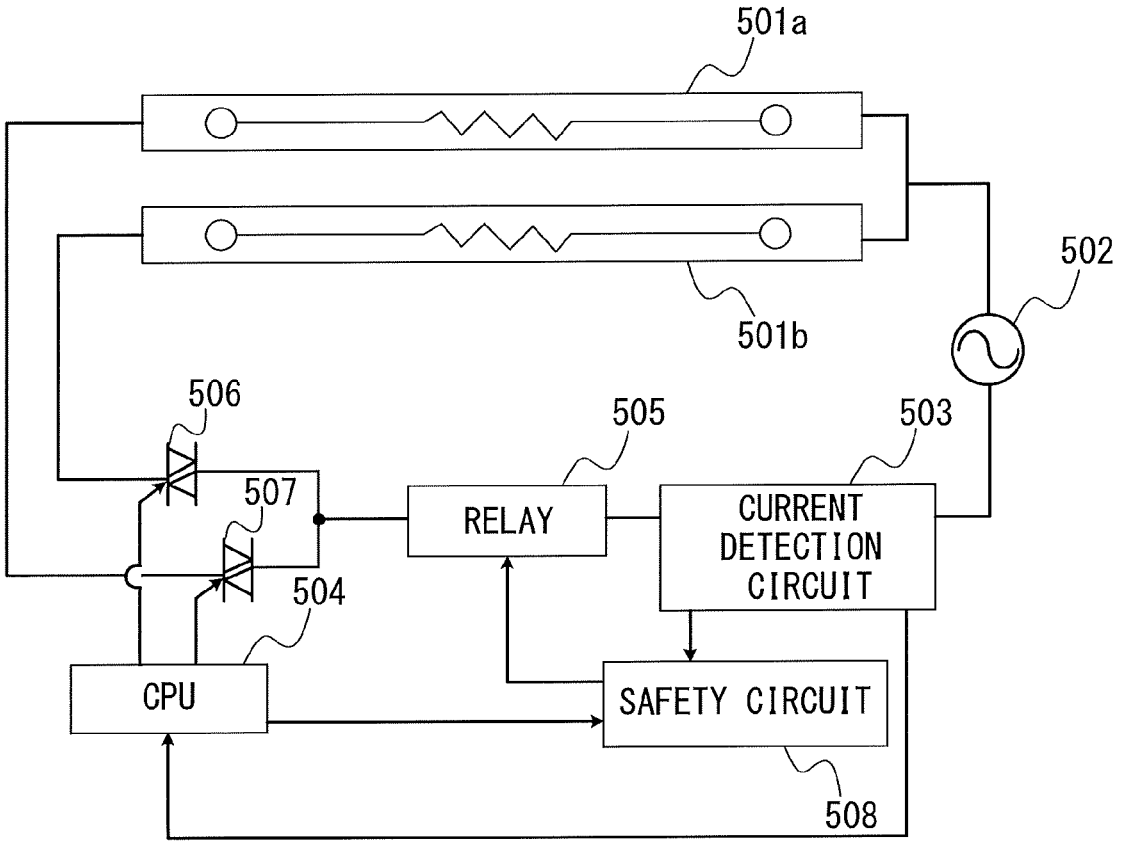
FIG. 10 is a diagram illustrating an example of the fixing controller for controlling current flowing into the fixing device of a conventional image forming apparatus.

FIGS. 8 and 9 are flowcharts illustrating an example of a processing procedure of the image forming apparatus of the present embodiment. Note that the sheet cassettes 18 stores sheets of four different sizes. Further, a description will be given in a case where the maximum sheet size capable of being stored in the sheet cassettes 18 is A4 size.

The CPU 101*a* determines whether the image forming apparatus 1 has recovered from a sleep mode (S301) or not. If it is determined that the image forming apparatus 1 has recovered from the sleep mode (S301: Yes), the CPU 101*a* determines whether or not the sheet size is changed after the latest detection of the resistance value based on the detection result from the sheet size detection sensor 115 (S302). It means that the CPU 101*a* determines whether the sheet size has been changed from, for example, A4 size to B5R size after the latest printing is completed or not. Note that the fact of whether the sheet size is changed or not can be determined based on the value stored in the sheet information storage area in the RAM 101*c*.

If it is determined that the sheet size has been changed (S302: Yes), or the image forming apparatus has not recovered from the sleep mode (S301: No), the CPU 101*a* determines whether or not the maximum sheet size set in the sheet cassettes 18 is A4 size. If it is determined that the maximum sheet size is A4 size (S303: Yes), the CPU 101*a* controls each triac such that the triac 37 is turned ON and the triacs 38, 30 and 31 are turned OFF (S304). Note that when printing is performed under this circumstance, all fixing heaters (111*a* to 111*d*) will be used (electrified). Therefore, the CPU 101*a* detects the resistance value of each heater in order before the processing of Step S304 is started.

The CPU 101*a* causes the fixing heater 111*a* to electrify (S305) and causes the current detection circuit 33 to detect the current value of the fixing heater 111*a* (S306). Note that the CPU 101*a* causes the current detection circuit 33 to detect a constant current. After the detection result from the current detection circuit 33 is stabilized, the CPU 101*a* controls the apparatus to perform current sampling. Further, the CPU 101*a* applies the current sampling method to other fixing heaters to make the current detection circuit 33 detect the current value.

When the detection of the current value of the fixing heater 111*a* is completed, the CPU 101*a* controls turning ON/OFF of each triac to electrify the fixing heater 111*b*. In particular, the triac 38 is turned ON and the triacs 37, 30 and 31 are turned OFF (S307) to electrify the fixing heater 111*b* (S308). Thereafter, the CPU 111*a* makes the current detection circuit 33 detect the current value of the fixing heater 111*b* (S309).

When the detection of the current value of the fixing heater 111*b* is completed, the CPU 101*a* controls turning ON/OFF of each triac to electrify the fixing heater 111*c*. In particular, the triac 30 is turned ON and the triacs 37, 38 and 31 are turned OFF (S310) to electrify the fixing heater 111*c* (S311). Thereafter, the CPU 101*a* makes the current detection circuit 33 detect the current value of the fixing heater 111*c* (S312).

When the detection of the current value of the fixing heater 111*c* is completed, the CPU 101*a* controls turning ON/OFF of each triac to electrify the fixing heater 111*d*. In particular, the triac 31 is turned ON and the triacs 37, 38 and 30 are turned OFF (S313) to electrify the fixing heater 111*d* (S314). Thereafter, the CPU 101*a* makes the current detection circuit 33 detect the current value of the fixing heater 111*d* (S315). Then, the CPU 101*a* controls the apparatus to turn OFF all triacs 37, 38, 30 and 31 (S316). Then, the CPU 101*a* completes the detection of the current value of the fixing heaters immediately after the startup of the image forming apparatus 1.

Also, if it is determined that the maximum sheet size is not A4 size (S303: No), it means that the maximum sheet size is smaller than A4 size. In this case, the CPU 101*a* determines whether the maximum sheet size is larger than A4R size (S319) or not. If it is determined that the maximum sheet size is larger than A4R size (larger than A4R size and smaller than A4 size) (S319: Yes), the CPU 101*a* performs the processing of Step S307. Note that, when printing is performed under this circumstance, the fixing heaters 111*b*, 111 *c*, and 111*d* will be used. Therefore, the CPU 101*a* detects the resistance value of each heater in order before processing of Step S307 is started.

Further, if it is determined that the maximum sheet size is not larger than A4R size (S319: No), the CPU 101*a* determines whether or not the maximum sheet size is larger than B5R (S320). If it is determined that the maximum sheet size is larger than B5R size (larger than B5R size and smaller than A4R size) (S320: Yes), the CPU 101*a* performs the processing of Step S310. Note that, when printing is performed under this circumstance, the fixing heaters 111*c*, and 111*d* will be used. Therefore, the CPU 101*a* detects the resistance value of each heater in order before the processing of Step S310 is started.

If it is determined that the maximum sheet size is not larger than B5R size (S320: No), the CPU 101*a* performs the processing of Step S313. Note that, when printing is performed under the circumstance, the fixing heater 111*d* will solely be used. Therefore, the CPU 101*a* detects the resistance value of the fixing heater 111*d* before the processing of Step S313 is started.

Thereafter, the CPU 101*a* determines whether an instruction to start printing (start print job) is received via the operation unit 102 (S317) or not. If it is determined that the instruction to start printing is received (S317: Yes), the CPU 101*a* starts printing in accordance with the instruction (S318). After the printing is completed, or if it is determined that the instruction to start printing is not received (S317: No), the CPU 101*a* makes the image forming apparatus 1 transition to a stand-by mode.

Note that, in this embodiment, a description has been given with regard to the detection of the resistance value performed before the printing is started, in which current is detected in the order of the fixing heater whose resistance value is low. Not limited to the above, the order of detecting the resistance value performed before the start of the printing may optionally be set. Also, in this embodiment, a description has been given in a case where the order to detect the current of each fixing heater is determined based on the maximum sheet size of the sheet as set in the sheet cassettes 18. Not limited to the above, the order to detect the current may be determined based on the sheet size of the sheet set in a particular sheet cassette.

As mentioned above, in the image forming apparatus of the present embodiment, any unnecessary delay of the print start time, in particular, any delay of print start timing can be prevented in a case where a second sheet and subsequent sheets are printed successively or even in a case where the image forming apparatus is recovered from a sleep mode. Further, according to the present disclosure, the image forming apparatus capable of preventing delay the print start timing after being powered ON or after being recovered from the sleep mode is provided.

The present invention has been described in detail by way of the above-mentioned embodiments, but the scope of the present invention is not limited to those embodiments. While the present invention has been described with reference to exemplary embodiments, it is to be understood that the invention is not limited to the disclosed exemplary embodiments.

The scope of the following claims is to be accorded the broadest interpretation so as to encompass all such modifications and equivalent structures and functions.

This application claims the benefit of Japanese Patent Application No. 2014-019245, filed Feb. 4, 2014, which is hereby incorporated by reference wherein in its entirety.

What is claimed is:

1. An image forming apparatus for heating and fixing a toner image formed on a recording medium, comprising:

a storage unit configured to store a recording medium;

an obtaining unit configured to obtain information regarding the size of the recording medium stored in the storage unit, a conveying unit configured to convey the recording medium stored in the storage unit;

an image forming unit configured to form an image on the recording medium conveyed by the conveying unit;

a fixing unit, having a plurality of heaters including a first heater performing heating based on the amount of the power supplied and a second heater performing heating based on the amount of the power supplied, configured to fix the image on the recording medium by heating the image on the recording medium using the plurality of heaters;

a control unit configured to determine a heater to which the power is supplied among the plurality of heaters based on the information obtained by the obtaining unit and configured to control the amount of power to be supplied to the determined heater based on the resistance value of the determined heater; and a detection unit, provided in a power line for supplying power to the plurality of heaters, configured to detect current values of the plurality of heaters; and a determining unit configured to:

in a case where the size of the recording medium stored in the storing unit is larger than or equal to a predetermined size, based on the information obtained by the obtaining unit, control the detection unit to detect the current value of the first heater and the current value of the second heater before the fixing unit fixes the image onto the recording medium, determine a first resistance value of the first heater based on the detected current value of the first heater, and determine a second resistance value of the second heater based on the detected current value of the second heater, and in a case where the size of the recording medium stored in the storing unit is smaller than the predetermined size, based on the information obtained by the obtaining unit, control the detection unit to detect the current value of the second heater before the fixing unit fixes the image onto the recording medium, and determine the second resistance value of the second heater based on the detected current value of the second heater, wherein the control unit is configured to control, in a case where the size of the recording medium is a first size, which is larger than or equal to the predetermined size, the amount of the power supplied to the first heater, and configured to control, in a case where the size of the recording medium is a second size, which is smaller than the predetermined size, the amount of the power supplied to the second heater.

2. An image forming apparatus according to claim 1, further comprising an input unit to which a command for designating the starting of printing is input, wherein the image forming unit is configured to form the image based on the command input from the input unit, and wherein the determining unit is:

configured to determine, in a case where the size of the recording medium stored in the storage unit is larger than or equal to the predetermined size, the first resistance value and the second resistance value after powering ON of the image forming apparatus and before the starting of forming the image based on the command by the image forming unit; and configured to determine, in a case where the size of the recording medium stored in the storage unit is smaller than the predetermined size, the second resistance value after powering ON of the image forming apparatus and before the starting of forming the image based on the command by the image forming unit.

3. An image forming apparatus according to claim 1, further comprising an input unit to which a command for designating the start of printing is input, wherein the image forming unit is configured to form the image based on the command input from the input unit, and wherein the determining unit is configured to detect, in a case where the size of the recording medium stored in the storage unit is smaller than the predetermined size, the current value of the first heater by the detection unit after forming of the image is completed by the image forming unit based on the command, and is configured to determine the resistance value of the first heater based on the current value of the first heater.

4. An image forming apparatus according to claim 1, further comprising an input unit to which a command for designating start printing is input, wherein the image forming unit is configured to form the image based on the command input from the input unit, and wherein the determining unit is configured to detect, in a case where the size of the recording medium stored in the storage unit is smaller than the predetermined size and the command is yet to be input from the input unit, the first resistance value by the detection unit after the second resistance value is determined by the detection unit, and configured to determine the resistance value of the first heater based on the current value of the first heater.

* * * * *